United States Patent [19]

Heil

[11] 4,107,479

[45] Aug. 15, 1978

[54] ELECTRO-ACOUSTIC TRANSDUCER

[76] Inventor: Oskar Heil, 1775 Parrott Dr., San Mateo, Calif. 94402

[21] Appl. No.: 720,357

[22] Filed: Sep. 3, 1976

[51] Int. Cl.[2] ..... H04R 1/20; H04R 1/34; H04R 7/02; H04R 9/02; H04R 9/04; H04R 9/06

[52] U.S. Cl. ..... 179/116; 179/115.5 VC; 181/155; 181/163; 181/173

[58] Field of Search ..... 179/116, 181 R

[56] References Cited

U.S. PATENT DOCUMENTS

| | | | |
|---|---|---|---|
| 1,273,459 | 7/1918 | Chudzikowski | 181/163 |
| 1,775,453 | 9/1930 | Foley | 179/116 |
| 3,015,366 | 1/1962 | Bishop | 179/116 |
| 3,636,278 | 1/1972 | Heil | 179/115.5 PV |

FOREIGN PATENT DOCUMENTS

| | | | |
|---|---|---|---|
| 2,260,741 | 6/1974 | Fed. Rep. of Germany | 179/181 R |

*Primary Examiner*—George G. Stellar

[57] ABSTRACT

A loudspeaker comprising a plurality of stages extended along a predetermined direction, each stage of which includes a movable diaphragm having a resonance out of the frequency range of reproduction and movable within a support structure. The diaphragms are driven transversely in unison by a distributed drive system capable of propagating longitudinal acoustical waves at a very high velocity and therefore also nonresonant within the range of the speaker. The drive system is connected to suitable electro-acoustic motional transformer such as a moving coil permanent magnet system. The coil longitudinal drive means and diaphragm masses are made exceedingly low so that the collective mass is comparable to the air mass in the immediate vicinity of the speaker which air mass serves to load the same. No damping materials are employed. The speaker is further characterized by being in extended form in which the diaphragm structure as a whole is constructed along a predetermined direction in space, and therefore approximates from a short distance away from the speaker a cylindrically propagating wave system. It is found tht such wave system results in a far lower storage of kinetic energy within the surrounding air mass so that exceptionally high transient response is achieved. Particular forms of the speaker system are disclosed utilizing graphite rods or graphite cables the latter being placed in tension, or an aramid polymer type fiber the bulk longitudinal acoustic propagating velocity of which is exceptionally high.

15 Claims, 10 Drawing Figures

32
50
60
52
46d
62
64
56
4
4
66
46c
48
61
5
5
30
46b
46a
34
38
40
44
42
78

ELECTRO-ACOUSTIC TRANSDUCER

BACKGROUND OF THE INVENTION

The present invention relates to electroacoustic transducers, i.e. loud speakers which are adapted to receive an electrical signal and to convert the same into sound energy for propagation. In particular the present invention is related to a form of loud speaker which is particularly adapted to reproduction of low and mid frequencies, i.e. frequencies of the range of 20 to 5,000 Hz.

Heretofore, loud speakers particularly those adapted for frequency work in the range from about 20 Hz to 5,000 Hz, have been limited in their effectiveness and faithfulness of reproduction due to one very distinct factor which is the slow propagating velocity of the acoustic information across the diaphragm. The sound propagates as transverse sound which is slow in comparison with longitudinal sound propagation. The diaphragms brake up into a multiplicity of resonant modes. When excited these resonances store elastokinetic energy causing a delay in sound emission till equilibrium is reached. When the excitation stops the stored elastokinetic energy is spent gradually re-emitted into unwanted overhanging sound waves, i.e. a failure of adequate transient response.

In typical cone type loudspeakers the diaphragm of the loudspeaker is capable of sound propagation by transverse waves in more than one direction, the radial direction and the circumferential direction. The sound propagation in the circumferential direction leads to a bell type vibrational modes, whereas propagation in a radial direction ultimately leads to a cone breakup. Each of these types of vibration are capable of causing interference with each other. Each of the types of vibrations tend to cause the cone to be less pliable for propagation of the other type of vibration in such a way that the increased rigidity involved causes changes in resonant frequency and therefore causes a resultant pitch variation in the modes being propagated. In other words, the wave which is being propagated causes an increase or possible decrease in the rigidity of the cone material and this causes the pitch shift either up or down correspondingly. The foregoing effects in relation in shifts and frequency variations and also in shifts in resonances result in gliding tones to which the ear is extremely sensitive due to speech recognition patterns which are highly developed in the human ear. In order to enhance the transient response of such cone diaphragm loud speakers, various damping materials have been utilized, such as viscous material diaphragm supports and massive quantities of sound deadening load. These materials in themselves absorb sound energy and therefor inherently make such conventional speakers inefficient. In addition, control of speaker motion has been obtained not only by the sound deadening loads into which they are operated but also by employing amplifiers having high damping factors and the like.

This effect causes frequency variations in existing resonances as function of time and resulting gliding tones to which our ear is extremely sensitive due to its use in speech recognition. The rigidity of a diaphragm is not constant but varies considerably when the diaphragm is engaged in the usual vibrational mode in which the waves propagate in a transverse mode; i.e. perpendicular to the diaphragm surface. The waves proposed for use in the present invention will not be propagating in a flat diaphragm but in a preformed, especially shaped, corrugated sheet which has greater rigidity and therefore greater sound propagating velocity and a higher resonant frequency. Such special shape enable the diaphragms of the present loud speaker to avoid internal resonances which cause such distortions.

In U.S. Pat. No. 3,636,278 entitled ACOUSTIC TRANSDUCER WITH A DIAPHRAGM FORMING A PLURALITY OF ADJACENT NARROW AIR SPACES OPEN ONLY AT ONE SIDE WITH THE OPEN SIDES OF ADJACENT AIR SPACES ALTERNATINGLY FACING IN OPPOSITE DIRECTIONS in the name of Oskar Heil, issued Jan. 19, 1972, a speaker system is disclosed in which its function can be characterized as providing a large moving diaphragm area to air motional area, sometimes called an air motion transformer. This type of speaker has been very successful in faithfully reproducing high frequencies in accordance with the principles set forth in said patent. However, the principles there disclosed suffer certain disadvantages when an attempt is made to apply those principles to the production of lower frequency sound, particularly in the forementioned range of 20 to 5,000 Hz. In general, the motional transformer as disclosed in U.S. Pat. No. 3,636,278 can be constructed for use at low frequencies but is found to be inefficient due to the high mass loading caused by air moving out the slots with consequent loss in transient response, particularly in the frequency range of high aural discrimination. As mentioned, the mass loading of the air itself is high because it is related to the velocity of the amount of air which must be moved. As is known, gross motion of a loud speaker at lower frequencies and the amount of physical air moved is much larger than at high frequencies. Since the motional transformer of said U.S. Pat. No. 3,636,278 is of the order of 5 to 1 that is to say, the air velocity is in range of 5 time greater than the velocity of the diaphragm materials causing such motion, and because the kinetic energy stored therein is proportional to the square of the air mass moved, (i.e. at factor of 25) it is seen that considerable additional kinetic energy must be exchanged between the air mass being moved and the speaker.

Accordingly, there is a need for a new and improved loudspeaker structure not subject to the foregoing limitations and disadvantages.

SUMMARY OF THE INVENTION AND OBJECTS

Before proceeding to summarize the characteristics of the present invention it will be useful to consider certain matters which have been heretofore ignored by those considering the design of electro-acoustic transducers (herein referred to by their common name, loudspeakers). In the past, the kinetic energy stored in sources generating sound waves have been considered, particularly at lower frequencies, to be so high as to render the kinetic energy and possible standing waves generated within the surrounding air volumes as negligible or unimportant. The present invention proceeds from the assumption that it is necessary that the loudspeaker structure itself be made of materials and have characteristics by which the stored kinetic energy within the loudspeaker is comparable to some appropriately defined air mass surrounding the same. Beyond a certain limit from the speaker the air mass serves to propagate acoustic energy in which the energy sound level decreases at the expected inverse r2 rate.

In addition to the foregoing there is a phenomena analagous to that in electro-magnetic energy propagation of radio waves by which such propagation is impeded by a type of variable impedence of the opening space, hereinafter termed "radiation resistance". Such radiation resistance also exists in the case of a loudspeaker. The assumption will be made in the present application that it is possible to build a structure which is extended sufficiently as to not be analyzable within the typical and known solutions of the origin of the sounds from point sources or from spherical models of such point sources.

With the foregoing in mind, the present invention is further predicated upon the ability to physically realize, with modern materials, a sound generating structure which is comparable in effective mass to the mass of the air surrounding the loudspeaker. In order to accomplish the foregoing the following has been found necessary. First of all, the loudspeaker has been constructed as an elongated source that is to say, it is constructed in a manner in which the sound propagation therefrom appears as an approximately cylindrical wave when considered from a short distance away from the speaker. By doing so the ratio of kinetic energy stored as standing waves within the air mass immediately surrounding the speaker can be made very low in comparison with the sound energy propagated away from the speaker.

In addition, the loudspeaker is not only structurally extended in space along a given dimension but is also constructed of specially selected materials, the equivalent mass of which can be made so low as to be comparable to the standing wave defined air mass representing radiation air resistance to the speaker. In fact, it has been found possible to virtually design a speaker of the type disclosed and claimed herein which is resonanceless and therefore requires absolutely no internal damping whatsoever. The presently disclosed speaker system is damped by its interaction with the surrounding air mass with which it interacts and into which it operates as a load. The foregoing has lead, therefore, to the development of a speaker requiring no damping materials whatsoever in its construction and which in addition requires no damping by the driving electronics, the sole damping for said speaker being in its interaction with the aforementioned surrounding air mass.

In one embodiment of speaker constructed in accordance with the present invention the speaker diaphragms themselves are constructed of specially formed polycarbonate film having a nonresonant shape and are peripherally supported by resonanceless hinge structures at each perimeter thereof. The diaphragm is utilized in each instance to form a stage of said loudspeaker, each stage of which is extended along a longitudinal axis and successive stages of which are themselves arranged to extend along a longitudinal axis and therefore define an approximation to a cylindrical radiative surface. The diaphragms of each stage are driven in unison from a single driving element by a plurality of distributed drive means, namely, rods which intercept the diaphragm of each stage transversely thereof. Such rods transmit sound vibrations in longitudinal mode are are structured and supported so as to assure absence of transverse vibration. Each stage diaphragm itself is arranged to have single mode motional characteristics any resonance of which has been designed by the arrangement and structure so as to have occurred outside the range of frequencies to be reproduced by said loudspeaker.

Longitudinal sound has about 10 times greater propagating velocity than tansverse sound. For that reason the structure can be physically long without resulting in resonance frequencies in the reproducing frequency range of the speaker.

In general therefore, it is the object of the present invention to provide a resonant-free loudspeaker structure for use particularly at low and mid frequencies.

It is the further object of the present invention to provide such a loudspeaker of the foregoing character which requires no damping, in its structure, in its surrounding support structure, or in the amplifier which drives the same.

It is a further object of the invention to provide a loudspeaker of the above character which does not require viscous damping materials in its support structures which materials have been heretofore employed for the purpose of damping out unwanted transverse vibrations especially in cone diaphragm speakers.

It is a further object of the present invention to provide a loudspeaker of the above character which is highly efficient and which possess other desirable loudspeaker characteristics, that is to say, a very low stored elasto-kinetic energy of its components and therefore and excellent transient response and an absence of resonances within a range of its operation.

It is a further object of the present invention to provide a loudspeaker which is reasonably compact which is simple to construct and which is very reliable.

It is a further object of the present invention to provide a loudspeaker of the above character which efficiently operates over the entire low and mid frequency range of reproduction from about 20 to 5,000 Hz.

It is a further object of the present invention in view of the foregoing objects and disclosures herein to provide a loudspeaker of exceptional clarity and purity of sound, which faithfully reproduces in minute detail musical signals applied to it without adding coloration or other intonation effects as thereto.

These and other object and features of the invention will become apparent from the following description and discussion when taken in conjunction with the accompanying drawings, of which:

DETAILED DESCRIPTION OF THE PREFERRED EMBODIMENTS

It will now be shown that there exists a lower air mass loading from a cylindrically propagating sound source than from a spherically propagating wave source. Consider a pulsating sphere and the air motion surrounding it for two extreme cases: (A) Where the frequency of pulsation is so high that the generated sound waves are small compared to the dimension of the sphere and, (B) where the frequency of pulsation is so low that the generated sound wave lengths are large compared to the dimension of the sphere. The physical laws governing the air motion in the two cases are very different.

In case (A) spherically propagating sound waves have wave energy density which diminishes with $1/r^2$. The total energy in a spherical shell of a given thickness is constant and independent of r since the area of the shell is proportional to $r^2$ ($r^2 \times 1/r^2$ is constant). In other words: all energy of the air is propagating sound energy. There is no standing wave energy. The energy of the sound waves is proportional to the square of the amplitude $a^2$, which means that the air motion amplitude is proportional to $1/r$.

In case (B) the air near the sphere is practically incompressible. The compressibility becomes appreciable only about a quarter wave length away, which is according to the condition of case B) far away from this sphere. The air motion is governed by the law of equal volume displacement in the different spherical shells. The area of the spherical shell is proportional to $r^2$. To make the volume displacement constant the air wave amplitude —a—must diminish proportionally to $1/r^2$ as compared to $1/r$ in the first case. The energy density is proportional to $a^2$ that is $1/r^4$ as compared to $1/r^2$ in case A). The total energy for a spherical shell is proportional to area multiplied by density, that is $r^2 \times 1/r^4 = 1/r^2$.

The actual energy distribution of the air surrounding a pulsating sphere which is small compared with the wave length and is a gradual transition between the two extremes, cases (A) and (B). As $r$ is increased the spherical shells become in size first comparable and then bigger than the wave length.

Figure 1:
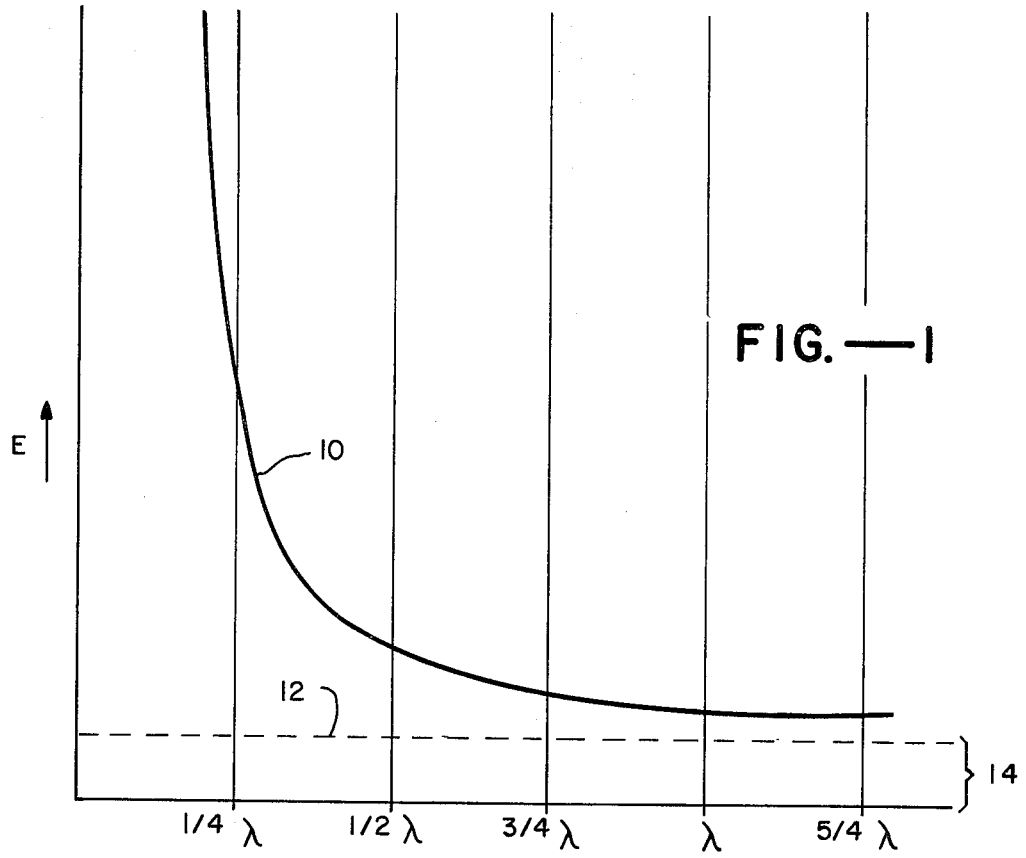
FIG. 1 is a graph depicting the amount of energy contained in a spherical shell surrounding a point sound source.

FIG. 1 shows the solution in the form of total spherical shell energy curve 10 as a function of r measured in wave length —λ— (solid curve). This total energy is divided by the dotted line 12. The constant energy 12 below the dotted line is the acoustical energy propagating away from the sphere. The area between the dotted line 12 and the solid curve 10 represents standing wave energy. The open space surrounding a sphere acts to reflect sound energy similar to the reflection on the open end of an organ pipe.

However, it is now found that this energy barrier is greatly reduced by going from a spherically to a cylindrically propagating wave generating source. For equal volume displacement the amplitude —$a$— then becomes proportional to $1/r$, the energy density is then proportional to $a^2$ or $1/r^2$. The shell area is then proportional to $r$ and the total energy in the shell of unit length is proportional $r \times 1/r^2 = 1/r$.

Figure 2:
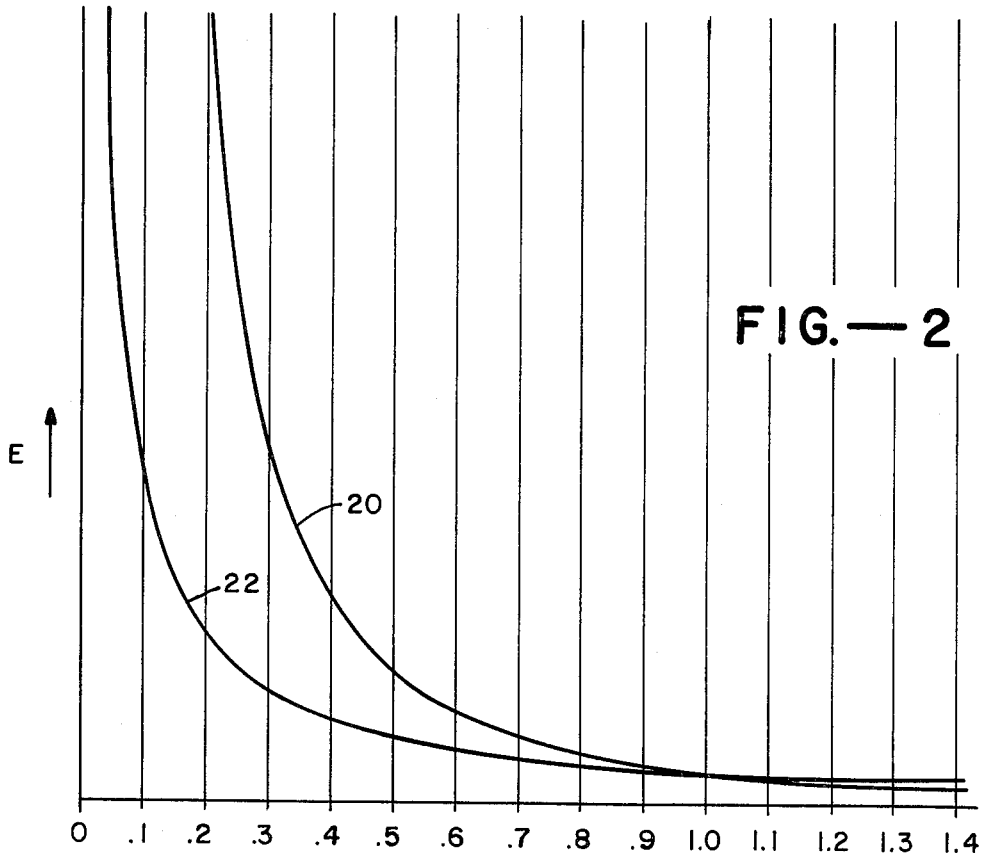
FIG. 2 is a graph depicting the amount of motional energy in a rigid gas surround spherical and cylindrical sound sources.

FIG. 2 illustrates the standing wave energies of the respective cases, the spherical model being shown at 20 and the cylindrical model at 22, the standing wave energy being represented by the area underneath the respective curves. The curves 20, 22 shown have been computed for a theoretically rigid or incompressable gas for reasons of simplicity, but they represent reasonable approximations for a real gas in the immediate vicinity of a sphere or cylinder; and, it is evident that there is considerably less stored or standing wave energy in the cylindrical case 22 than in the spherical case 20.

For reasons which are set forth herein it is possible to construct a loudspeaker in accordance with the present invention in which the kinetic energy of the motional energy is comparable with the kinetic energy stored in the cylindrical model just explained.

The essential features of the present invention relate to the following elements which will be briefly described in generality here and then more specifically described in their constructional features in connection with the preferred embodiments. The essential concepts in the present invention relate to the use of a distributed drive system operating from a single lightweight coil and so arranged and constructed as to form a very rigid structure in which the rigidity of the coil itself is transferred to and made a part of the various speaker diaphragm elements through a drive system which propagates sound energy in an extended direction by means of longitudinal propagation waves having virtually no transverse waves.

These longitudinaly transmitted waves appear at each of a succession of specially designed and constructed diaphragm elements so as to intersect said elements and to activate them acoustically. The elements themselves are so constructed as to have virtually no resonant characteristics within the range of operation of the speaker. By utilizing the combination of advantages obtained within a cylindrical, i.e. linearly elongated type speaker arrangement together with the achievement of non-resonant structures used as diaphragms within the aforementioned elongated structure and by maintaining the same in its entirety in in-phase operation the present invention achieves the ability of bringing together in one loudspeaker construction a virtually non-resonant structure which operates throughout its range to deliver an exceptionally pure sound source which is substantially free from internal resonances of any type and which is loaded largely by the surrounding effective air mass. In practice the sound transmission system which operates between successive diaphragms in the elongated structure of the present invention consists of materials having an exceptionally high longitudinal sound propagating velocity. Such structure can, for example, be made of materials having longitudinal bulk sound propagation velocities of from 12Km/sec to 15 Km/sec which within the physical size of the structures contemplated is more than adequate to assure satisfactory in-phase between elements. Obviously should adjacent speaker elements become out of phase sound cancellation and other disturbing effects would occur. In the descriptions which follow an example of the present invention will be given with respect to a structure utilizing rigid rods which are driven by a single moving coil structure connected to a plurality of diaphragms the entirety of which is structurally interconnected as a unitary moving element. The rods in such structure may be driven in compression and tension by the moving coil or may be placed in substantially complete tension if so desired. A second form of the invention that will be disclosed utilizes a graphite yarn which is maintained in tension by the means disclosed such that it is capable of transmitting longitudinal vibrations in a satisfactory manner. Also disclosed in each embodiment are structures utilizing a multiplicity of such rods or fiber elements said multiplicity being anchored to the sound generating source, for example, the moving coil, magnetic material, or other sound generating source capable of converting electronic signals into motional energy. As disclosed herein the longitudinal propagation of acoustical energy along the extended axis of the loudspeaker systems disclosed is accomplished through the use of a plurality of such sound propagating elements which are uniformly distributed in relation to the sound generating element itself and in relation to the diaphragms driven by them. By so doing, the present invention prevents possible internal vibrations and imbalances in relation to the driving of the diaphragms of this speaker. This system is thus characterized as a distributed drive structure.

What is apparent from the foregoing discussion is that if one were to totally disregard the energy which is stored in any of the elements of speaker's physical structure and only to regard energy stored in the air volume surrounding the speaker there still exists such a degree of stored energy as to appreciably affect the performance of even the most perfect speaker. In this surrounding air volume which is for lower frequencies not an impractical size there are very few solutions which would permit reduction of the stored energy to acceptable levels.

In addition, the present invention discloses a configuration in which this is accomplished within a structure which approximates, to a reasonably close degree, an extended or line source type loudspeaker, that is to say, one which is extended in a single direction in space. In this way the present loudspeaker will be found to behave more like an air pump working on a gaseous fluid mass in which the mass and motional characteristic of the gaseous fluid, i.e., the surrounding air mass within the vicinity of the loudspeaker is directly felt by the electro-magentic converting means as the significant loading factor for the speaker.

Referring now more particularly to FIGS. 3 through 7 there is shown one form of preferred embodiment constructed in accordance with the present invention and consists generally of a outer framework 30 having a hollow interior subdivided by plurality of walls so as to form substantially identical stages of an extended loudspeaker. The framework 30, in general consists of an outer support flange 32 which surrounds the entire speaker to support the same. The support flange 32 extends upwardly along each side of the speaker and closes over its top in a continuous fashion and extends downwardly into communication with a lowermost section 34 of the speaker which serves as a coil housing, which may be and usually is and enclosed structure all around its sides. Thus, the lowermost section is enclosed within a surrounding wall structure, a side-wall, and a top wall 36 which also serves as part of the speaker baffle construction, only a part of which is shown for simplicity of illustration.

Means is provided within the base structure and substantially sealed therein by the aforementioned walls for converting energy delivered from electrical terminals 38 into motional form and consists of, for example, of a moving coil 40 mounted within a permanent magnet structure 42 and held in centered or other suitable position therein by a spring loaded spider structure generally indicated at 44.

In the present invention, it is desirable to utilize a very light weight coil form which is wound with a suitable winding. One such structure consists of a lamination of graphite or carbon film formed with epoxy. Such structures are highly rigid while being noncircumferentially conductive. A typical such structure consists of a 5 mil thick sheet constructed of 60% carbon fiber and 40% epoxy cement and so oriented so that the carbon fibers are in alignment with the direction of motion of the coil so as to prevent eddy current loses. One such structure was constructed with a two inch diameter coil body edge wound with an aluminum ribbon, the latter forming a coil surrounding the coil form. This structure is of acceptably light mass and is found to be very satisfactory in the present application in view of the demand for high rigidity coupled with low mass. It has in addition a very good heat conductivity in the axial direction for inversed heat dissipation.

A plurality of speaker stages **46*a*, 46*b*, 46*c*, 46*d*** are established, and constructed above the coil housing, so that a description in detail of one such stage will serve as a description of each of them. It should also be understood that while four active stages are shown in the drawing, the same is so limited only for the sake of demonstration and that a larger number of such stages may be employed. However, as will be discussed subsequently herein it is an essential feature of the present invention that a sufficient number of loud speaker stages are employed so as to achieve an extended source in one dimension so as to satisfy the criteria of effective cylindrical sound propagation at the higher frequency of operation of said loudspeaker. It is a further characteristic of each of the stages that they are simultaneously driven from minimum number of or a single coil, although an additional coil system could be placed at the other of structure to work in unison with that shown; and, the use of more than one coil will be disclosed in the explanation of an alternate embodiment of the present invention.

Means is provided for simultaneously driving each of the loudspeaker stages in the present invention and consists of a distributed set of parallel graphite fiber rods 48, four being shown in the present embodiment. As is shown, each of the graphite rods terminate in a spring 50 at its upper end while being rigidly connected to the coil form at each of their lower ends by suitable cement. The springs support the weight of the moving structure. However springs can be added at the lower end of the structures. It is the purpose of these tensioning springs if employed to keep the rods in tension so that longitudinal compression driving forces generated by motion of the coil can be transmitted through the rods without causing the same to be driven into a state of compression, in which state transverse bending modes have an opportunity to be introduced. However, it will be understood that it is possible with the materials shown and described herein, to build a structure in accordance with the present invention which does not have such tension producing elements. If a complete tensioning system were employed the rods could be replaced by graphite yarn forming cables through the structure, one form of which will be discussed hereinafter.

Figures 3, 4, 6, 7:
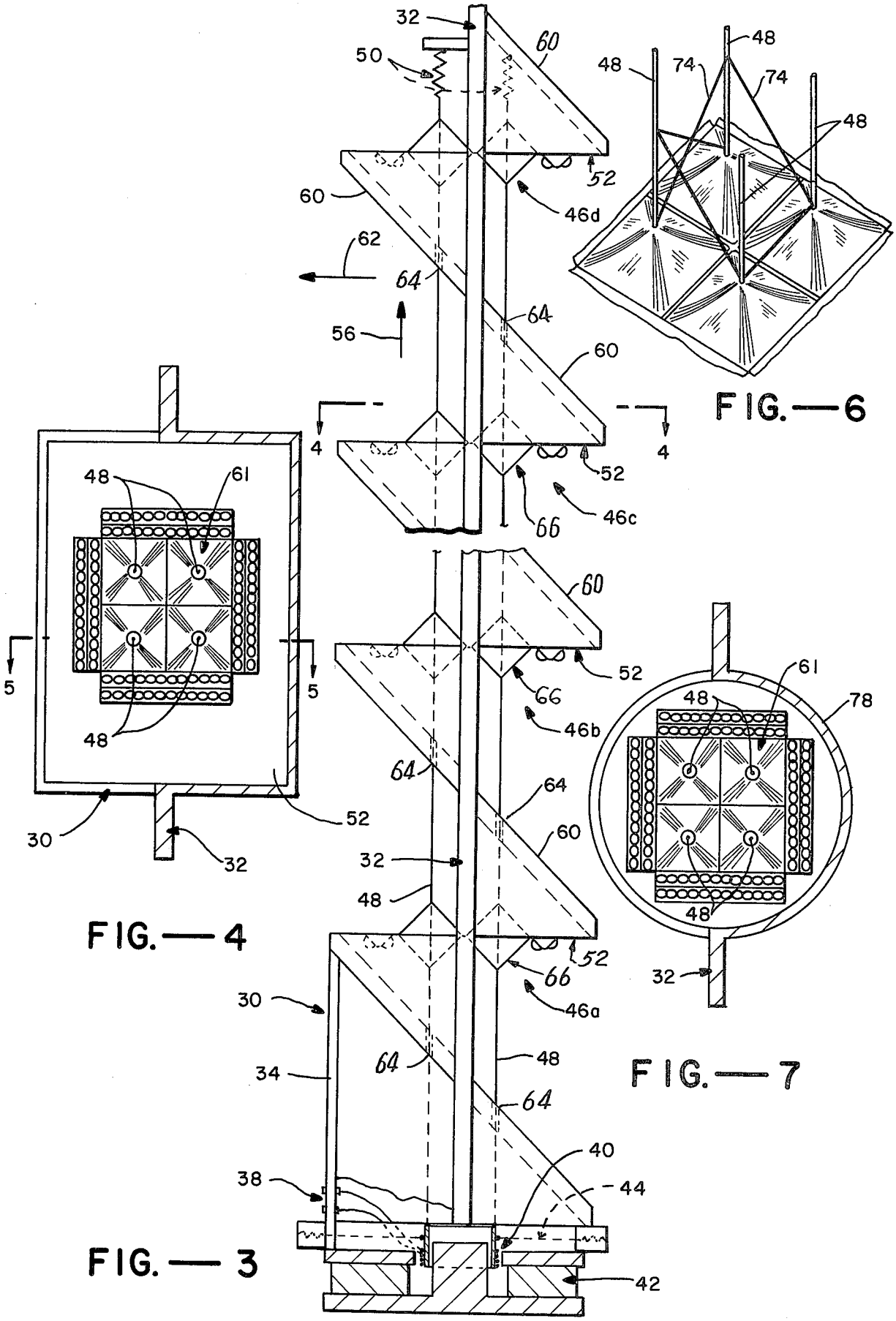
FIG. 3 is a longitudinal elevational view of an electroacoustic loud speaker constructed in accordance with the present invention.
FIG. 4 is a crosssectional view taken along the lines 4—4 of FIG. 3.
FIG. 6 is an isometric view illustrating a diaphragm and diaphragm linkage of FIG. 1 and constructed in accordance with the present invention.
FIG. 7 is a crosssectional view similar to that of FIG. 4 and illustrating an embodiment of the invention constructed in circular cross-section.
Figure 5:
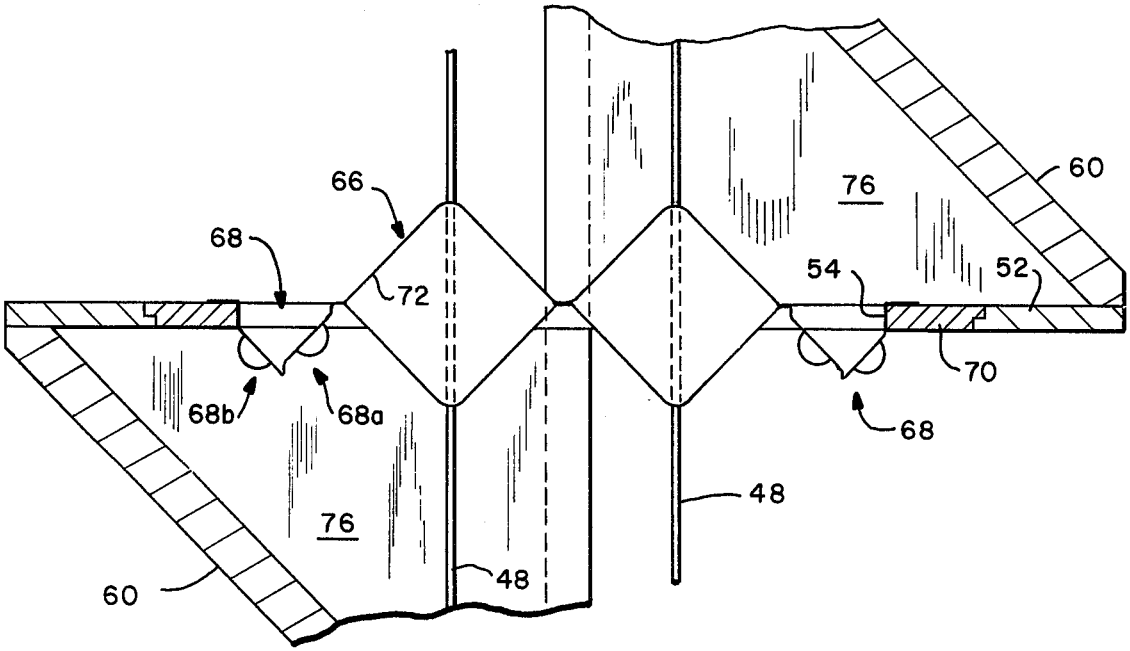
FIG. 5 is an enlarged detailed view taken generally as indicated at 5—5 of FIG. 4.

Each stage of the loud speaker consists of an baffle plate 52 with a centrally located planar diaphragm unit 66, the detail structure of the latter being shown in FIG. 6. Each diaphragm unit 66 is disposed in an opening 54 in each baffle plate. A deflecting plate 60 is interposed between adjacent of said diaphragms for causing sound to be deflected from there in a second direction 62 which is perpendicular to the first direction 56. Thus, each stage of the loudspeaker is bounded by an upper and lower deflection plate 60 between which is positioned one of the diaphragm units 66. The orientation of each of the deflecting plates is preferably about 45° in disposition in respect to the direction 56 for the purpose indicated. However, each of such deflection plates may be disposed with respect to the direction 56 at any of a wide variety of angles. It is found, however, that quite satisfactory performance has resulted from the aforementioned disposition at 45° even though units have been built with angles as low as 30° and have also shown the desirable characteristics of the present invention. It will also be appreciated that it is possible to increase this angle to a value somewhat greater than 45°. Each deflector plate provided with a plurality of holes 64 so as to permit free passage of the distributed driving means, i.e. the graphite rods upwardly from the cone and through the structure. Referring now in particular to FIG. 5, the details of structure of a typical diaphragm structure is shown. In general this structure consists of a central diaphragm unit 66 which is supported on a surround 68 mounted within the opening 54 of each baffle plate 52. It is practical to mount the diaphragm 66 and surround 68 in a rigid ring 70 which can then be inserted and fastened within the opening 54 of the baffle plate. The diaphragm 66 consists of a central portion characterized by a plurality, i.e. four, of shaped cones 72 being generally pyramidal in shape at their bases, while being developed into generally bell shape toward their apexes. Each such pyramidal base is further formed by fastening the same together with substantially identical opposite mirror image part to form therewith upper and lower portions which are sealed at all points of contact mating to define an air-tight enclosure or volume, which is filled with air.

Each of the distributed drive means; namely, the rigid graphite rods 48, pierces a single one of said enclosures centrally of the apex thereof and is securely fastened in air-tight relation to each such apex, with a rigid reinforcement. The reason for employment of such an apex structure will be discussed in greater detail hereinafter. However, in general it is so constructed to rigidify the material of which the diaphragm is made while preserving a low mass. As will be easily understood, if an extremely low mass planar structure or film were driven in the manner shown, the same would have a tendency to vibrate and resonate at many unwanted frequencies. Accordingly, a sufficient number of such subdivied diaphragm units 66 are provided and their size is dictated by the consideration that the diaphragm shall not be resonant within the range of frequencies that it is designed to reproduce.

In that connection, the structure of which the diaphragm is made consists of an extremely rigid material for instance, polycarbonate film, which may be, for example, 3 mils thick and vacuum formed into the shape shown. The diaphragm, i.e. the moving element driven by the aforementioned rods is supported within its support ring by a flexible surround 68 which permits movement of the diaphragm in response to movement of the rods but which avoids many of the problems of more conventional speaker diaphragm surrounds. Hydroformed aluminum foil of 1 mil thickness can also be used for diaphragm and surround material with very good resulting reproduction of sound. In this invention, the surround is constructed of the same material as the diaphragm namely, an exceedingly rigid polycarbonate film or aluminum foil. This film is constructed with a plurality of small bubbles formed in one sheet thereof and backed by a second sheet which is planar. As shown, the surround includes two parts, **68*a*, 68*b* a first part 68*a*** being attached to the diaphragm structure itself through a small vertical section, which section assures rigid coupling of the diaphragm motion to the surround. The surround consists of a two part hinge, therefore, which is interconnected by an additional coupling section for the same purpose.

As will be noted from FIG. 6 each diaphragm unit 66 consists of a number of uniformly distributed geometric shapes and one drive rod 48 passes through the center of the cross-sectional area of each geometric shape. The enclosed air volume within each element of the diaphragm serves to further raise the resonant frequency of the structure out of the range of reproduction desired.

The entire speaker unit consisting of identical stages and being driven from a single coil results in additional mass savings, and further the structure of the coil being made of carbon fiber and epoxy in the form shown together with aluminum windings is exceedingly rigid and light. The rods themselves are approximately 0.060 inch thick. In one embodiment, the mass of the moving components of a four stage speaker amounted to about 15 grams, i.e. about 3.75 grams per diaphragm. This results in an equivalent effective mass to area approximately the same as a 6 inch air mass. In addition to the foregoing there may be occasions to crosstie the elements of the structure, such crossties 74 being illustrated in FIG. 6 and can consist, for example, eighth inch wide, 5 mil thick graphite strips interconnected above and below the points of connection of the rods with the diaphragm, in the form shown. Referring to FIG. 7, there is shown an alternate configuration in cross-section of a speaker constructed in accordance with the present invention in which such surround as just described takes a circular configuration as illustrated at 78.

In connection with the description of the embodiment of FIGS. 3 through 6 there was disclosed one alternate configuration in which the drive rods were placed in tension by spring members located at each end of such drive rods. In such configuration the drive rods can be made of a solid rod material, of hollow rigid rod material of tubular character, or of flexible cable construction any one of which, when fully tensioned is equivalent; and termed therefore, in general, as cable means. However, if a flexible cable structure were utilized an advantage in weight savings of the epoxy of which the rigid rods are made would be saved at the expense, however, of the additional mass of the tensioning springs in the comtemplated alternate tensioned embodiment. In view of the foregoing, there is now disclosed in FIGS. 8 through 10 another embodiment of the invention which utilizes a pair of loudspeakers constructed in accordance with the present invention arranged side by side and driven in opposite phase to each other through a system of cables in tension as will now be described.

Figure 9:
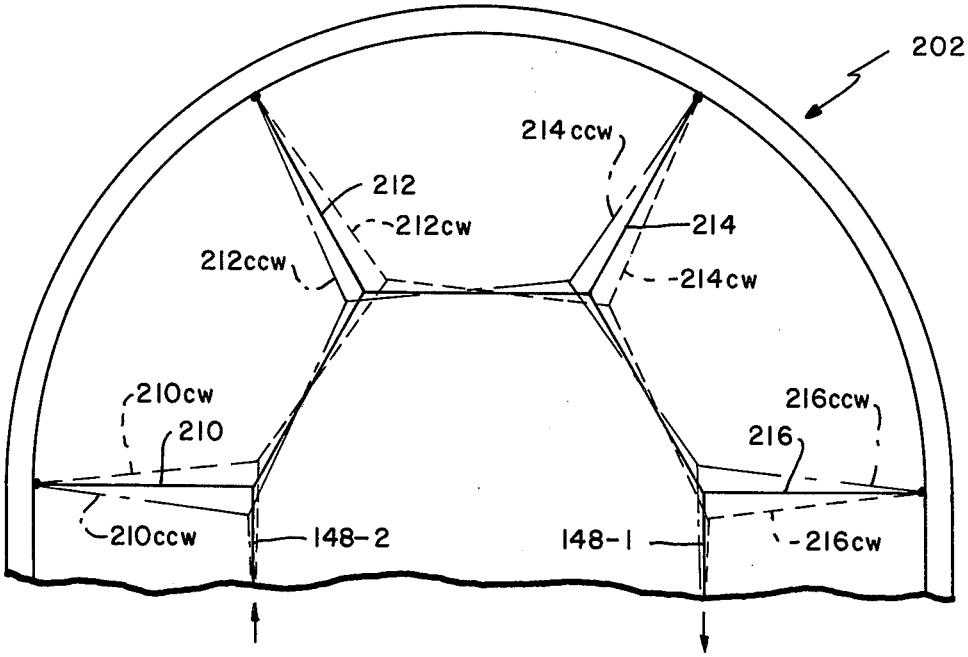
FIG. 9 is an elevational view of the upper tension and motion reversing structure of the electroacoustic transducer of FIG. 8 and showing the same in various longitudinal vibrating modes.
Figure 8:
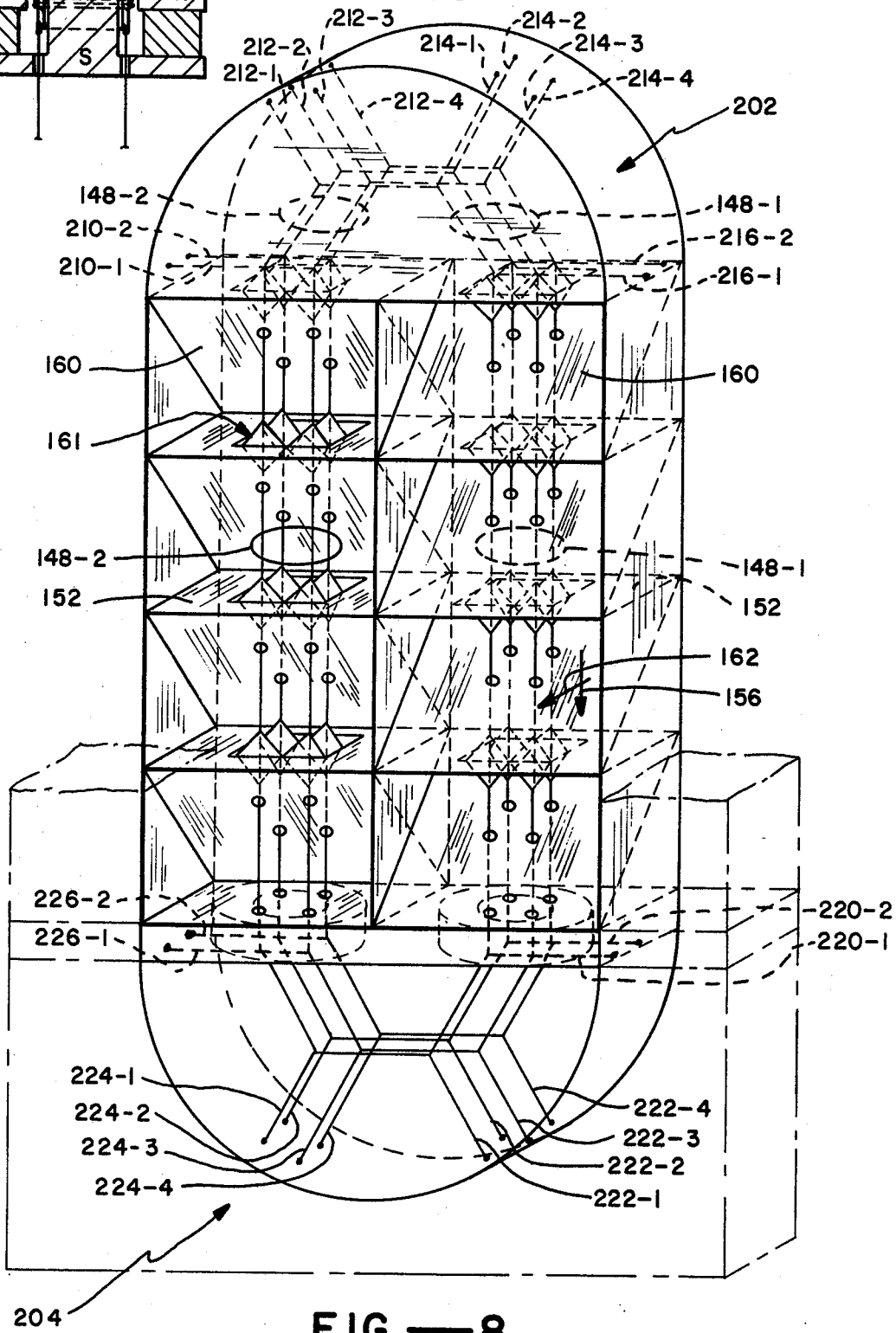
FIG. 8 is an isometric illustration of an alternate embodiment of the present invention in which the internal sound transmissive elements are maintained in tension showing motion reversal units on top and bottom.

Thus, referring particularly to FIG. 8, the second adjacent loud speaker is also shown and includes a section of mirror image general construction to that previously described and positioned alongside it. Means forming tension linkage 5 interconnected between all diaphragms of each section in series consisting of cable sets 148-1, 148-2 which are interconnected by motion reversers 202, 204 for transfering the tension and motion of the respective linkage cables therebetween in phase coherence. The various part of like structure as compared with the embodiment of FIG. 3 have been given like numbers (plus 100) to avoid a further repetitious description which is considered unwarranted. As shown in particular FIG. 9, it is a principal characteristic of the structure of this side by side unit that the motion and tension reversing mechanisms 202, 204 are employed at each end thereof so that it has been possible to eliminate the use of springs while nevertheless maintaining a system utilizng drive cables which are attached to the diaphragm units and which are maintained in tension and thereby capable of fast transmission of longitudinal motional waves. These mechanisms 202, 204 serve to change the direction of motion of movement of the respective cable while maintaining the tension the same. Referring then specifically to FIG. 9, a geometrical configuration is illustrated in which the tension in cable sets 148-1, 148-2 are changed in direction by being held from the end wall of the structure by the use of four radial strings 210, 212, 214, 216 only one set being shown but the others being appropriately numbered as are the lower set 220-1,2 222-1, 224-1, 226-1, all so setforth in FIG. 8. In this application the tensioning members which serve as drive rods are preferrably constructed of a highly rigid material, such as Keflar, which is produced by duPont and available in a yarn form. Such material is exceedingly light weight and has an acceptably high longitudinal sound propagating velocity of approximately 12 kilometers per second in bulk. The direction reversing radial members, 210, 212, 214, 216 however, need not be constructed of highly elastic material, but in fact may be constructed of material having ordinary elasticity, for example nylon cord. The geometry is self-illustrating in that movement of the drive means causes rotation of the various radial about their points of support rotating in unison back and forth, alternately clockwise and counter-clockwise. This configuration has a built-in equilibrium force which produces a tendency to go into its normal intial position which is shown by the solid lines. If it deviates from this into the extreme position, either cw (dot-dash line) or ccw (dash line), this results in a stretching of all the radial cords. Of course, they have elasticity and they tend to go back into their normal position. Thus these reversal units have a restoring force which always operates to return the system to neutral position in the absence of a driving force. The reason each of the radial cores is stretched is because this does not move the center of the rotation of the tension cables. The center of motion of the supporting radial cords is located at the outer support surface and therefore any movement of the tension cables about an equilibrial position will tend to try to expand the length of the tension drive cable. This can not occur, and so will be taken up by the elasticity of the radial cords. Accordingly, it is a particular advantage of the tension and motion reversal mechanism disclosed in FIG. 9 that the mass thereof is exceedingly low since there is no required use of high mass motion reversal systems, for example rollers, heavy springs or the like but provides all required functions.

Figure 10:
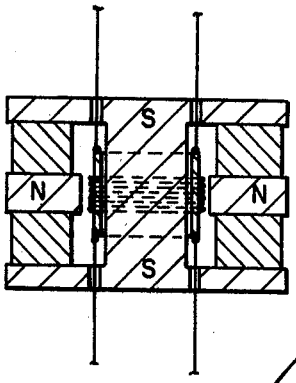
FIG. 10 is a detailed cross-sectional view of the moving coil magnet structure of that portion of the embodiment of FIG. 8 of the present invention.

It is a further constructional feature of the loudspeaker illustrated in FIG. 8 through 10 that two moving coil transducers are provided which are operated in push-pull, so that proper phasing relationships will be maintained throughout the structure.

Referring now particularly to FIG. 10, one of the moving coil transducers is shown in detail in cross-sectional view. In contrast to normal dynamic drive units, this is a double unit which has a moving coil 280, not on the outside, but located centrally within a closed magnetic structure having few fringing fields. The advantage of this is that the total field of the magnetic structure is very small, and all magnetic material well utilized. The motion of the moving coil is shown centrally is transmitted with the ropes to the outside without any loss. In order for the cables to pass from within the magnetic structure of the dynamic drive unit shown in FIG. 10 holes are provided passing through the upper and lower plates of the south magnets as shown. Obviously, the amount of fringing magnetic fields which are lost from this structure are extremely small indeed. A further feature of the structure of the embodiment of FIGS. 8 through 10 is that no coil positioning means other than the positioning cables themselves is required, thus additionally reducing the motional mass of the system.

To those skilled in the art to which this invention pertains many additional features, objects and modifications of the same will occur and accordingly, the scope of the present invention should soley result from the scope of the appended claims when taken together with the accompanying description. For example, while a hexagonal motional reversing system having hexagonally located radials is disclosed it can theoretically be shown that the number of radials can be increased while maintaining a fully operable system. In addition, the extent of the speaker can be made longer than that suggested herein even beyond what would appear to be a resonant wave length of the uppermost frequency of the speaker operation, since it will be understood that each of the diaphragms in turn transmits of certain amount of energy and thus the uppermost diaphragm or that diaphragm furtherest away from driving coil or driving unit receives and operates to transmit the least amount of energy. In that connection, an ultimate system could be even conceived in which the drive means were tapered in thickness, the thickest portion being attached to the drive means, while the thinest portion was most remote from the same.

I claim:

1. In a loudspeaker: a plurality of speaker stages aligned in a direction comprising a longitudinal axis for the loudspeaker; each speaker stage comprising a baffle plate extending perpendicular to said longitudinal axis of the loudspeaker, a diaphragm opening in said baffle plate, a sound emanating rigid non-resonant diaphragm disposed in said opening, hinge members on the periphery of said rigid diaphragm mounting said diaphragm in said opening, a deflecting plate extending at an acute angle from one side of the baffle plate to an opposite side of the baffle plate of the adjacent speaker stage thereby defining an opening between adjacent baffle plates through which sound is adapted to emanate at right angles to said longitudinal axis, the area of each said opening through which sound emanates being greater than the area of each said diaphragm; an acoustic generator for responding to an electrical signal for creating an acoustic motion; and a plurality of unitary drive means capable of longitudinal sound propagation interconnected between said acoustic generator and each of said diaphragms for moving the same in unison, said drive means being uniformly distributed with respect to the cross-sectional area of each diaphragm, whereby each said diaphragm moves bodily as a rigid unit.

2. A loudspeaker as in claim 1 in which said acoustic generator is of the moving coil type, said coil being supported and limited in transverse motion by a plurality of radial cords attached to the coil in equally spaced positions thereabout and springs attaching said radial cords to the support structure at a position remote from said coil.

3. A loudspeaker as in claim 1 in which each said diaphragm is made of polycarbonate film.

4. A loudspeaker as in claim 1 in which each said diaphragm is made of aluminum foil.

5. A loudspeaker as in claim 1 in which each said diaphragm comprises a plurality of membrane portions having a generally conical shape configuration and interconnected to form a sealed pyramidal air space therein, and further in which said drive means comprises a plurality of discrete elongated members capable of transmitting longitudinal sound waves therethrough, said members being arranged and constructed together with said diaphragm conical portions so as to intersect the same at the apex thereof.

6. A loudspeaker as in claim 1 in which said drive means comprise a plurality of separate elements each placed in tension and supported within said loudspeaker structure in fixed connection with each of the diaphragms therein.

7. A loudspeaker as in claim 6 wherein said elements comprise flexible cables.

8. A loudspeaker as in claim 1 in which said drive means comprise rigid rods.

9. A loudspeaker as in claim 8 in which said rods are made of graphite fiber bonded with epoxy.

10. A loudspeaker as in claim 8 including cross brace reinforcing means interconnected between the drive rods.

11. A loudspeaker as in claim 10 in which said reinforcing means comprise graphite fibers cast in means for forming them into a rigid, light weight structure.

12. In a loudspeaker: a speaker housing; a plurality of speaker stages aligned in a longitudinal direction and comprising one section of the loudspeaker; each speaker stage comprising a baffle plate extending perpendicular to the longitudinal direction of alignment of said stages, a diaphragm opening in said baffle plate, a sound emanating rigid diaphragm disposed in said opening, a deflecting plate extending at an acute angle from one side of the baffle plate and extending to an opposite side of the baffle plate of the adjacent speaker stage thereby defining an opening between adjacent baffle plates through which sound is adapted to emanate at right angles to said longitudinal axis, the area of each said opening through which sound emanates being greater than the area of each said diaphragm; an acoustic generator for responding to an electrical signal for creating an acoustic motion; and drive means comprising a plurality of separate elements each placed in tension and interconnected between said acoustic generator and each of said diaphragms for moving the same in unison; a second section mounted adjacent said one section; said drive means passing through said one section in one direction and through said second section in the opposite direction; and means interconnecting said sections for transferring the tension and motion of said separate elements between said sections in phase coherence.

13. A loudspeaker as in claim 12 in which said motion transferring means comprises a plurality of radial cords interconnected between space and positions along the speaker housing along radials of a semi circle.

14. A loudspeaker as in claim 13 in which said plurality of radial cords are equally spaced to thereby deform said separate drive elements along a regular polygonal shape.

15. A loudspeaker as in claim 13 in which said radial cords are four in number whereby said separate drive elements conform to a hexagonal semi-structure and intersect with each said radial cord at 120°.

* * * * *